US008069897B2

(12) United States Patent
Kraeutler

(10) Patent No.: US 8,069,897 B2
(45) Date of Patent: Dec. 6, 2011

(54) FAST DOOR WITH CONTACT DETECTING MEANS

(75) Inventor: Bernard Kraeutler, La Villette (FR)

(73) Assignee: Nergeco (FR)

( * ) Notice: Subject to any disclaimer, the term of this patent is extended or adjusted under 35 U.S.C. 154(b) by 120 days.

(21) Appl. No.: 12/300,613

(22) PCT Filed: Apr. 25, 2007

(86) PCT No.: PCT/FR2007/000700

§ 371 (c)(1),
(2), (4) Date: May 29, 2009

(87) PCT Pub. No.: WO2007/135254

PCT Pub. Date: Nov. 29, 2007

(65) Prior Publication Data

US 2010/0065231 A1 Mar. 18, 2010

(30) Foreign Application Priority Data

May 12, 2006 (FR) ..... 06 04242

(51) Int. Cl.
*E05F 15/20* (2006.01)

(52) U.S. Cl. ..... 160/3; 160/1; 160/8; 160/264; 160/310

(58) Field of Classification Search ..... 160/1, 3, 160/8, 264, 310; 49/27; 200/61.43
See application file for complete search history.

(56) References Cited

U.S. PATENT DOCUMENTS 4,478,268 A * 10/1984 Palmer ..... 160/310
5,207,256 A * 5/1993 Kraeutler ..... 160/84.02
5,426,293 A * 6/1995 Miller et al. ..... 250/221
5,791,392 A * 8/1998 Fernandez Lopez ..... 160/238
6,474,395 B2 * 11/2002 Weiss ..... 160/237

(Continued)

FOREIGN PATENT DOCUMENTS

DE 36 18 766 A1 12/1987

(Continued)

OTHER PUBLICATIONS

English Translation of PCT Written Opinion of International Searching Authority—PCT/FR2007/000700.

(Continued)

*Primary Examiner* — Blair M. Johnson
(74) *Attorney, Agent, or Firm* — Cantor Colburn LLP

(57) ABSTRACT

The invention concerns a fast door comprising: a structure having in particular two posts (3) in each of which is provided a slide rail (16) and a transverse lintel-forming element (4), and a flexible curtain (12) connected to the structure at the lintel-forming element (4) via electromechanical means controlling the lowering and lifting of the curtain (12), the curtain (12) incorporating at least one flexible reinforcing bar (13, 29) inserted in receiving means provided in the curtain (12), the flexible reinforcing bar (13, 29) capable of being engaged at its ends in each of the slide rails (16) and capable of bending to be released at least from one rail (16) without being subjected to permanent deformation which would impair the operation of the door once reinstalled in its rails. The door further includes means for detecting any contact with the curtain associated with at least one flexible reinforcing bar (13, 29), the detecting means capable of having a normal operating condition when the bar (13, 29) is rectilinear and an abnormal operating condition under the effect of a contact with the curtain (12).

16 Claims, 4 Drawing Sheets

U.S. PATENT DOCUMENTS

| | | | | |
|---|---|---|---|---|
| 2007/0261305 | A1* | 11/2007 | Kraeutler | 49/27 |
| 2010/0236725 | A1* | 9/2010 | Kraeutler | 160/1 |

FOREIGN PATENT DOCUMENTS

| | | | |
|---|---|---|---|
| DE | 3618766 | | 12/1987 |
| DE | 94 18 885 | U1 | 3/1996 |
| DE | 9418885 | | 3/1996 |
| DE | 29623251 | * | 3/1998 |
| DE | 197 47 830 | A1 | 4/1999 |
| DE | 19747830 | | 4/1999 |

OTHER PUBLICATIONS

International Search Report PCT/FR2007/000700; Dated Sep. 26, 2007.

* cited by examiner

FAST DOOR WITH CONTACT DETECTING MEANS

This invention relates to a fast door fitted with a flexible screen capable of preventing or allowing passage through an opening in a wall.

Doors which possess a screen cut from a flexible material such as PVC canvas have been known for several decades. The low inertia of such screens enables these doors to be operated with great speed.

These doors are particularly useful for limiting the loss of heat from a room to which access is controlled, by virtue of the great speed with which the screen can be both lowered and raised.

Thought has also been given to limiting the costs of operating these doors. In particular, thought has been given to fitting fast doors with reinforcing bars having the feature of being made of a material that has a certain degree of flexibility. Thus, in a collision between the screen and, for example, a handling vehicle, one or more flexible reinforcing bars can deform and pop out of the door jambs in which the ends of each bar are normally engaged. With this arrangement, which is described in document EP-A-398791, the door suffers no irreversible damage in the event of a collision. The bar is then simply re-engaged, by an appropriate device, in the jambs to return the door to its normal operation.

It will therefore be seen that the normal method of coping with a collision with a fast door has hitherto been essentially passive. In other words, when the collision occurs between the screen and a handling vehicle or a person, the object has been to minimize the effects. This collision coping method has been perfectly satisfactory and has been a considerable advance on previous techniques whereby, in a collision, the screen and/or any reinforcements it may have, are damaged and require complete or partial replacement.

However, the principle of a door in which the reinforcing bars and the screen move away in front of a vehicle when the vehicle strikes them can have its drawbacks in that an allowance has to be made for the period during which the door has to be re-engaged in its tracks.

It is clear, therefore, that improvements can be made to current fast doors in terms of the way in which accidental collisions are handled, and more generally in coping with contacts between the flexible screen of a fast door and an external action.

Sectional doors built up from rigid slats are also known. These sectional doors move slowly because of the inertia of the slats. It is known from documents DE 19 747 830, DE 36 18 766 and DE 94 18 885 that the operation of these doors can be made safer by fitting to the bottom of the door a flexible strip incorporating various detecting means such as optoelectronic means. Thus, when the sectional door meets an obstacle while it is moving, the flexible strip is squashed between the obstacle and the door, and this triggers the detecting means. This operating principle is very suitable for a slow-moving sectional door. However, it cannot be transposed to a fast door, which travels at a much higher speed that can be of around 1 m/s. Because of the high speed at which the screen of a flexible door moves, it is not a good idea to have a detecting means mounted against a rigid slat which will form a bumper in a collision.

It is an object of the invention to provide a flexible screen door that responds actively to a contact with the screen.

This invention relates to a fast door capable of closing an opening in a wall; this door comprises:

a structure having in particular two jambs, in each of which a track is formed, and a transverse lintel element, and a flexible screen connected to the structure through the lintel element by electromechanical means controlling the lowering and raising of the screen, the screen incorporating at least one flexible reinforcing bar inserted in receiving means formed in the screen; the bar is engaged at its two ends in the corresponding tracks and can bend and come out of at least one track without suffering permanent deformation such as could prevent the correct operation of the door when placed back in its tracks.

The door also has screen contact detecting means connected to at least one flexible reinforcing bar, which detecting means can exhibit a state of normal operation when the bar is straight and a state of abnormal operation when the bar is bent owing to a contact.

The basis of the invention is to make use of the flexibility of a screen reinforcing bar as an indicator of the operation of a door. The invention provides a flexible reinforcing bar with detecting means which are activated when the flexible reinforcing bar bends in response to an external action applied to the screen. The perception of a contact is therefore immediate because one of the screen's own components is being used to signal an anomaly in the operation of the door. Notice that the door according to the invention can detect collisions occurring not only vertically but also horizontally.

In one possible embodiment of the invention, the detecting means have at least one emitter and at least one receiver, each connected rigidly to the same bar, at a distance from each other and coplanar with the bar in such a way that at least one beam is propagated between the emitter and the receiver, the beam being parallel to the flexible reinforcing bar in normal operation of the door, and at least one beam being broken when the flexible reinforcing bar is bent, causing misalignment of the emitter with respect to the receiver.

In concrete terms it may be envisaged that the detecting means take the form of an emitting/receiving couple mounted on a flexible reinforcing bar so as to face each other. In this way, a beam propagating between the emitter and the receiver is parallel to the flexible reinforcing bar so long as the flexible reinforcing bar is straight. A straight flexible reinforcing bar indicates that there is no stress and therefore that the door is operating normally. Should the flexible reinforcing bar be bent, the emitter and receiver become misaligned, causing the propagation of the signal to be interrupted. Interruption of the beam is therefore the sign that there has been an accidental or intentional contact with the screen. Beam interruption can then trigger one or more actions such as raising the screen and/or giving a visual and/or acoustic warning.

In one embodiment, the screen has horizontal guide means comprising at least one flexible or inflexible bar, each end of which is engaged in one of the tracks, and contact detecting means connected to a flexible reinforcing bar located at the bottom edge of the screen.

The flexible reinforcing bar to which are connected the contact detecting means situated on the bottom edge of the screen is preferably approximately forty centimeters distant from the horizontal reinforcing bar immediately adjacent to it. This arrangement provides room for an area in which the screen can come out of the jambs in the event of a collision with an object or can absorb contact with a pedestrian.

In another embodiment, the screen has lateral guide means that keep the lateral edges of the screen in the jambs and has at the bottom edge of the screen a flexible reinforcing bar that is provided with contact detecting means. These guide means may for example be enlargements or rings of the lateral edges of the screen which are engaged in C-section jambs.

Under another definition of the door according to the invention, the screen, whose lateral edges are engaged in the tracks of the jambs, has a flat surface without guide means and has at the bottom edge of the screen a flexible reinforcing bar that is provided with contact detecting means. To maximize the sensitivity of the detecting means, the emitter and receiver are located at the respective ends of a flexible reinforcing bar. The housing means for a flexible reinforcing bar take the form of two superposed strips between which are sandwiched two consecutive panels defining a sheath in which a transverse flexible reinforcing bar can be engaged.

Another possibility is for the housing means of a flexible reinforcing bar to take the form of a tarpaulin folded on itself and attached to the bottom transverse edge of the screen.

To mount the emitter and receiver on a flexible reinforcing bar, it may be envisaged that at least one of the flexible reinforcing bars is provided with at least two brackets, both located in a single plane passing through the bar, one supporting an emitter and one a receiver.

In one arrangement which avoids erroneous beam interruptions, at least one of the brackets attached to one of the bars comprises a jacket for keeping at a distance the walls of the sheath in which said flexible reinforcing bar is engaged.

With the same end in view as the previous arrangement, at least one sleeve can be positioned between an emitter and a receiver on one of the flexible reinforcing bars in such a way as to keep at a distance the walls of the sheath in which said flexible reinforcing bar is engaged. This arrangement can be extremely useful with wide doors.

In order to give a bar the flexibility which will enable it to trigger, if required, the detecting means, at least one of the flexible reinforcing bars may be made of a material such as a fibrous composite that will allow the bar to bend transversely so that when an action is applied transversely to it the emitter and receiver become misaligned and/or come out of at least one of the tracks.

For the bottom transverse edge of the screen, at least one of the bars may be a spiral spring equipped at each end with a rigid tube which is engageable in a track. The flexible bar thus performs a dual function because it both softens a collision, particularly with a pedestrian, and its bending is used as an indication of an anomaly.

It is also envisaged that each of the jambs comprises, at its top end, means for re-engaging a bar in the track with which said jamb is provided. Thus, if the collision is great enough for one or more bars to be bent and come out of either or both of the tracks, the simple act of raising the screen will cause the bar to re-engage in a track. To feed the bar back into position, use may be made of a deflector guiding it into the track; the rising screen, sliding against the outside of one or both of the jambs, reaches the deflector and is fed back into the track.

In order that it may be understood clearly, the invention is described with reference to the drawing appended hereto and showing, by way of non-restrictive examples, various embodiments of doors according to the invention.

Note that parts common to different embodiments have the same reference numbers.

Figure 1:
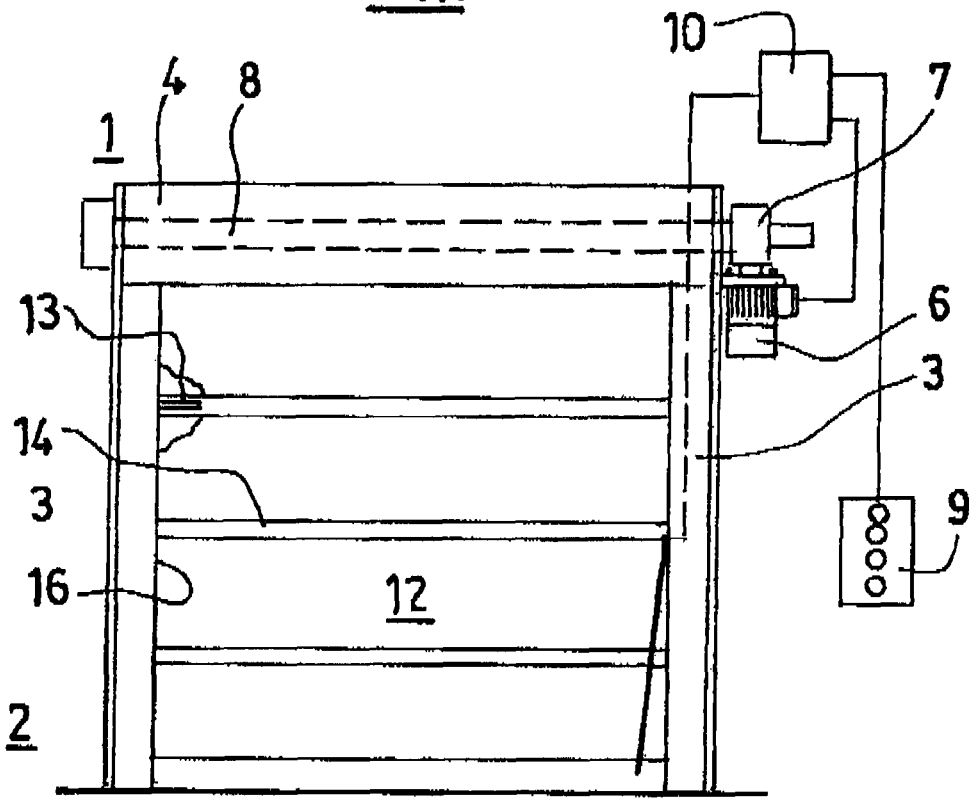
FIG. 1 is a front view of a door according to the invention.

To commence the description of the invention, reference will first be made to FIG. 1, which shows in front view a door 1 installed against a wall 2 in which an opening is formed.

This door comprises a structure consisting of welded and/or composite parts. The door structure consists, in the example illustrated, of two lateral jambs 3 framing the opening in the wall 2, and an upper transverse casing 4 forming the door lintel.

Installed on one of the jambs 3 is an electromechanical assembly comprising among other things a motor 6 and a speed reducer 7. This electromechanical assembly drives a transverse shaft 8 supported by bearings at the top of each jamb 3. The transverse shaft 8 is protected by a transverse hood 4. A console 9 is connected to control electronics 10 which transmit control instructions to the electromechanical assembly. The opening defined by the jambs 3 and hood 4 is closed by a screen 12 of flexible material such as PVC canvas.

As can be seen in FIG. 1, the screen 12 is provided with multiple transverse flexible reinforcing bars 13.

The example depicted has four bars 13 but this of course is purely indicative and depends essentially on the size of the door and the forces it may experience.

The screen 12 is made up of transverse panels of a PVC-type flexible material. In the example shown there are four of these panels whose long sides are welded to each other. At the join between two panels is a sheath 14. Each sheath 14 consists of two superposed strips of flexible material between which are sandwiched the long sides of the two panels which are adjacent to them.

The strips forming the sheaths 14 may be conventionally ultrasound welded and thus provide a space in which to insert a transverse flexible reinforcing bar 13.

The topmost panel of the screen 12 is connected to the shaft 8 running along the door lintel, so that when the shaft is turned the screen 12 winds onto it and allows a person or object to pass through the door. Turning the shaft in the opposite direction lowers the screen 12 and closes the door.

The screen 12 is engaged laterally in tracks 16 provided for this purpose in each jamb 3. The transverse flexible reinforcing bars 13 are also engaged in the tracks 16 in such a way as to transmit to the door structure forces caused for example by the wind acting on the screen 12.

As in the prior art, the transverse flexible reinforcing bars 13 may be made of composite material such as pultruded glass fiber so that the whole has sufficient flexibility to allow them to escape from the tracks 16 when the screen is forced beyond a certain level. A typical example of the screen being forced would be, for example, a collision with a handling vehicle.

In the context of the invention, one or more flexible reinforcing bars 13 are fitted with contact detecting means.

Figure 2:
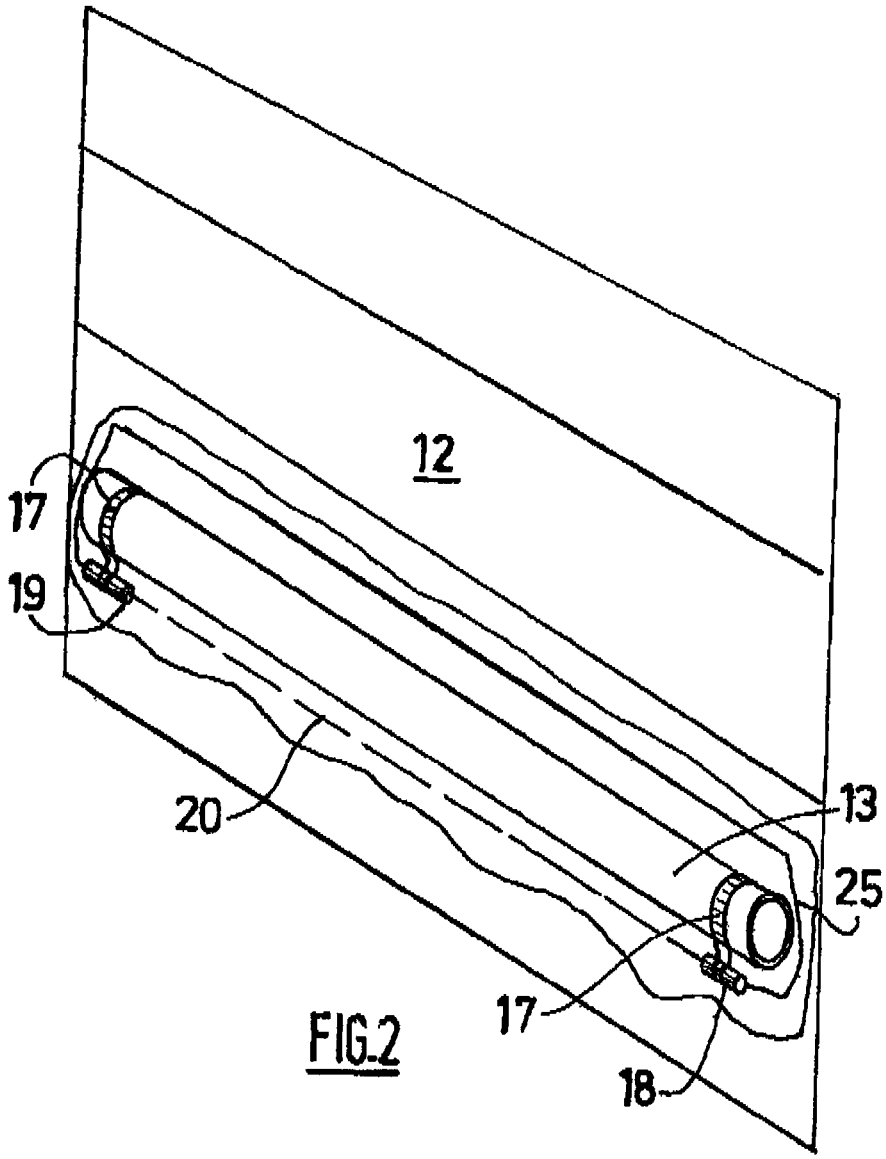
FIG. 2 is a perspective view of a screen for the abovementioned door, with partial cut-away through one of its reinforcing bars.

FIG. 2 shows one of the embodiments of these contact detecting means. As the figure shows, one of the reinforcing flexible reinforcing transverse flexible reinforcing bars 13 is provided with two brackets 17, one at each end: one of these brackets 17 carries an emitter 18 and the other a receiver 19. A beam 20 is thus propagated between the emitter 18 and the receiver 19. The beam may be an optical, radio, electromagnetic or infrared beam. As will be made clear later, it is important that the signal emitted by the emitter 18 has a narrow spread angle.

Figure 3:
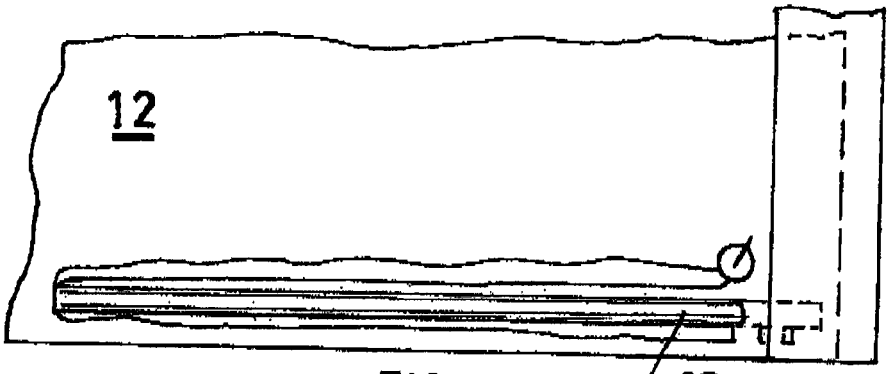
FIG. 3 is a front view with partial cut-away of the screen through a reinforcing bar.

In normal operation of the door, as depicted for example in FIGS. 2 and 3, the beam 20 is propagated along an axis parallel to the flexible reinforcing bar 13.

Figure 4:
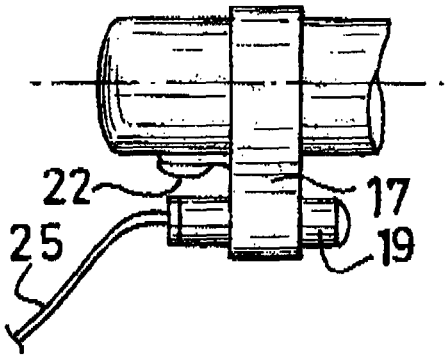
FIGS. 4 and 5 are front and side views, respectively, of a bracket for the detecting means.
Figure 5:
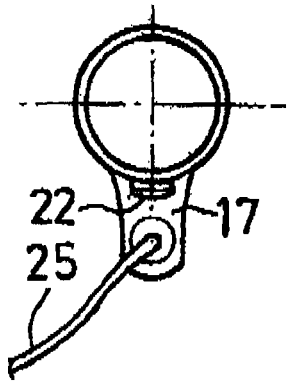

FIGS. 4 and 5, which show a side view and front view of the bracket 17 supporting the emitter 18 and receiver 19, illustrate the fact that both the emitter 18 and the receiver 19 are contained in the same plane as the flexible reinforcing bar 13 itself. In the example illustrated, it is also the plane formed by the screen 12; the emitter 18 and the receiver 19 being positioned underneath the flexible reinforcing bar 13.

One point to be remembered is that the emitter 18 and the receiver 19 lie within a plane passing through the flexible reinforcing bar 13.

It should also be observed that the brackets 17 arranged at either end of the flexible reinforcing bar provide rigid retention of the emitter 18 and receiver 19 on the flexible reinforcing bar 13.

As can be seen, a rivet 22 is used for this purpose to mount the brackets 17 on the bar 13.

As can be seen in the figures, a wire connection 25 connects the emitter and receiver to the door control electronics 10.

Figure 6:
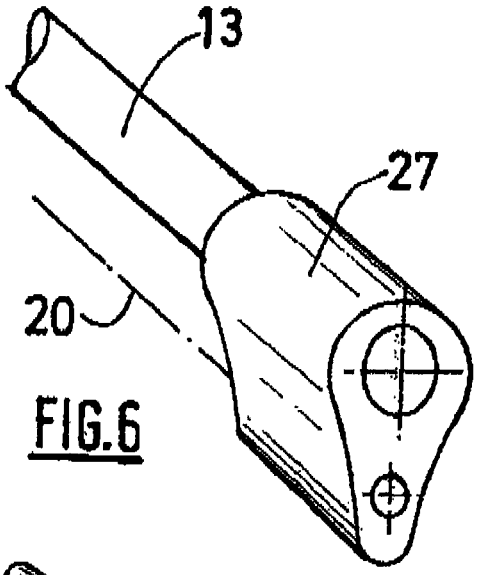
FIG. 6 is a perspective view of a variant of a bracket for the detecting means.
Figure 7:
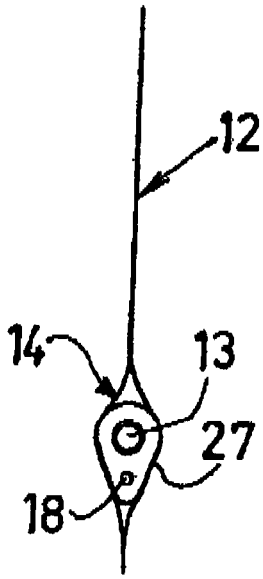
FIG. 7 is a side view of this bracket inserted in a flexible screen.
Figure 8:
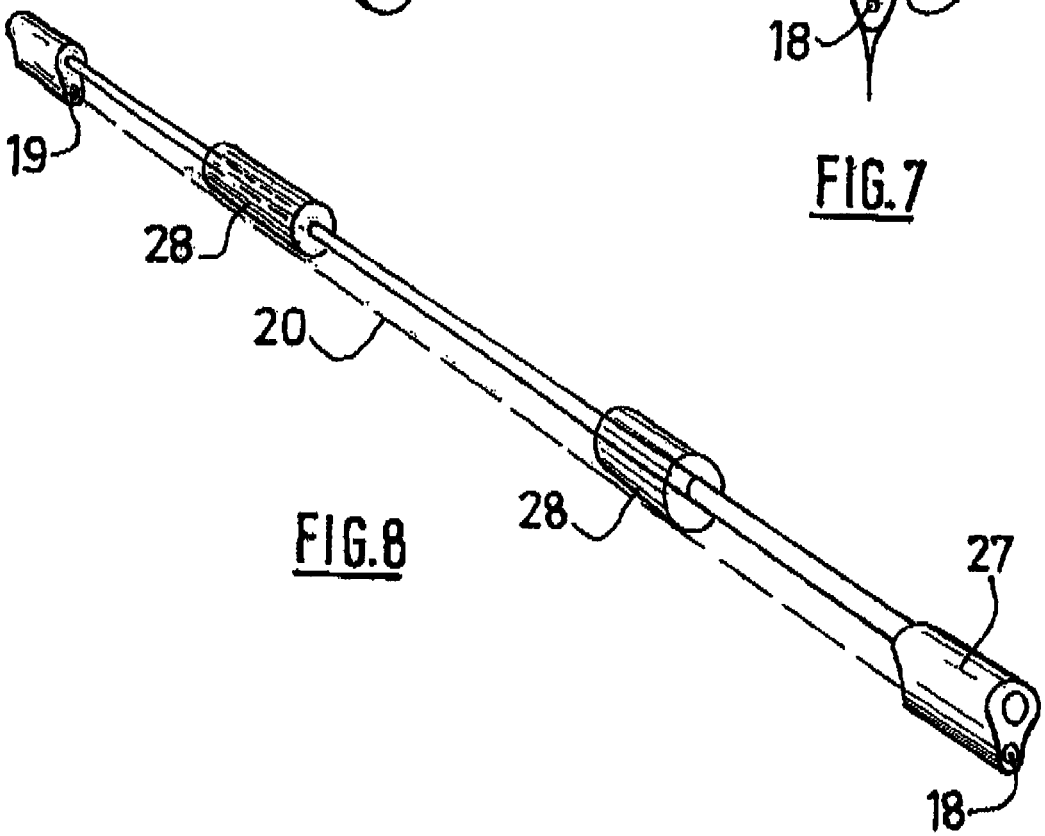
FIG. 8 is a perspective view of a bar fitted with an optional sleeve.

FIGS. 6 and 7 show a variant of the brackets 17 used to mount the emitter 18 and receiver 19 pair. Here, the brackets have a casing 27 which is cam-shaped in the example illustrated and has the function of holding apart the walls forming the sheath 14 in which the flexible reinforcing bar 13 is engaged.

This arrangement allows good propagation of the beam 20 to be maintained between the emitter 18 and the receiver 19 without the propagation of the beam being disturbed by the walls of the sheath 14 itself.

For the same purpose, flexible reinforcing bars 13 of great length, for example greater than 2.5 meters, may be fitted with one or more sleeves 28 which locally provide the spacer function and keep the walls of the sheath 14 apart.

Thus, in normal door operation, that is to say raising and lowering of the screen without disturbance, the beam 20 remains parallel to the flexible reinforcing bar 13 and the emitter 18 and the receiver 19 face each other directly.

If however an action is exerted on the flexible reinforcing bar 13 provided with the contact detecting means, the bar will by its very nature bend at the point of application of the action.

Since the emitter 18 and the receiver 19 are both fixed rigidly to the bar 13, they will now be pointing in different directions. In other words, the emitter 18 and the receiver 19 are no longer in the same plane as the flexible reinforcing bar 13, which, being itself bent, is now crooked rather than straight.

Since the emitter 18 and the receiver 19 are now misaligned, the receiver 18 is no longer receiving the beam 20. This interruption in the propagation of the beam between the emitter 18 and the receiver 19 is then transmitted to the control electronics which can then place the door in an abnormal operating mode. As mentioned earlier, the beam 20 has a narrow angle of spread, which makes it very sensitive to any deviation.

This abnormal operating mode may take various forms. It may involve raising the screen 12 and/or triggering a visual and/or acoustic alarm and/or a telephone, radio or TCP/IP signal to a maintenance team.

Figure 9:
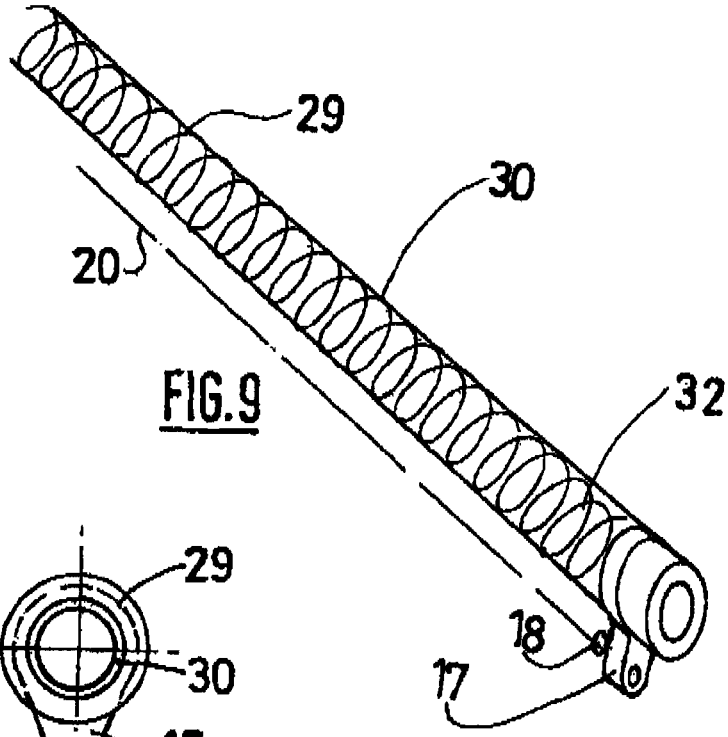
FIG. 9 is a perspective view of an embodiment of a flexible bar to which the detecting means have been fitted.
Figure 10:
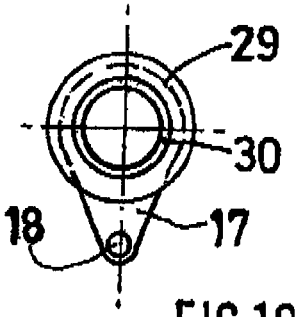
FIG. 10 is a side view of the bar shown in FIG. 9.
Figure 11:
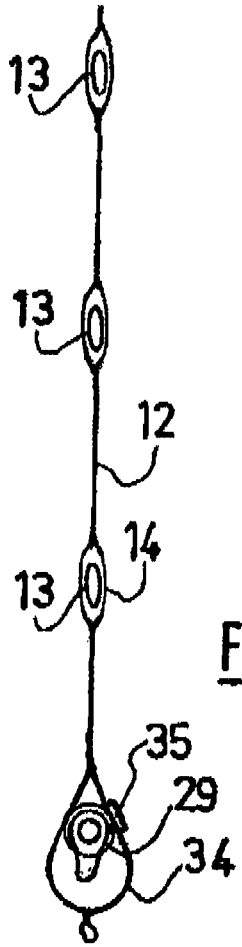
FIG. 11 is a side view of a flexible screen incorporating the bar shown in FIGS. 9 and 10.

FIGS. 9-11 illustrate another embodiment of a door in which a bar 29 is located at the bottom end of the curtain 12. The bar 29 may comprise a central part consisting of a metal helical spring 30 inserted in a tubular foam sheath 31, and two lateral parts 32 which may consist of tubes: these tubes may for example be steel tubes to which the spring 30 can be welded. It is however conceivable to produce the tubes in a composite material.

In this embodiment of the bar 29, the flexibility of said bar is of course conferred by the spring 30 which forms its central part. The fact that the bar 29 which thus constitutes the bottom part of the screen 12 is highly flexible is a major advantage in responding to a collision between the screen 12 and, for example, a person.

If, in the drawing, the central part is the greater part of the length of the bar 29, it is possible to provide a flexible region along one or more localized segments of the bar 29.

The bar 29 has similar arrangements to those provided for a transverse flexible reinforcing bar 13. To take an emitter 18 and a receiver 19, it may have two brackets 17, one at each end of the bar 29.

The operation of the bar 29 is thus equivalent to that of the bar of FIGS. 2-8 since, in the event of an action on the bar 29, it bends. The bending of the bar 29 interrupts the alignment of the emitter 18/receiver 19 couple.

FIG. 11 shows more particularly the bar 29 at the bottom edge of the screen 12. The screen 12 is then provided with a tarpaulin 34 along its bottom to form a pocket, and a bar 29 as shown in FIGS. 9 and 10 is inserted into this pocket.

To attach the bar 29, a system of rivets 35 may be used, passing through the tarpaulin 34 forming the sill of the screen 12. This arrangement prevents the bar 29 from rotating, which would confuse the contact detecting means.

A highly advantageous arrangement in the implementation of the invention may be noted.

The bar 29 forming the bottom edge of the screen may be placed at a substantial distance from a transverse (flexible or inflexible) reinforcing bar of the screen.

In practice, this distance may be approximately 40 cm. This is of particular significance in the response to one very frequent type of collision involving a handling vehicle and the bottom of the screen 12 when the latter is descending. In this situation, because the bottom bar 29 of the screen 12 is so flexible, the screen 12 retreats in front of the handling vehicle; the detecting means mounted on the bar 29 are activated and the control electronics order the screen 12 to rise. Because of the large distance between the bar 29 and the transverse reinforcing bar immediately parallel to it, the screen 12 is therefore stressed only (i) in that part of the screen 12 which causes the least damage to the handling vehicle and to the load which the latter is transporting, and (ii) in that part of the screen 12 which is the most flexible, thus safeguarding the integrity of the screen 12.

There is also the possibility of leaving the bottom 40 cm of the screen free. In other words, this bottom part containing the bar 29 is not guided laterally with respect to the jambs. In a collision with a person or vehicle, the bar 29 will deform and trigger the detecting means. The fact that the screen 12 is not guided at its bottom end is not detrimental to the triggering of the detecting means because, in the case of the bar 29, in a collision, the bar 29 would deform simply because of its flexibility.

It should be observed that the arrangement according to the invention involving attaching detecting means to a flexible bar can be implemented on any type of flexible screen, whatever guide means are used to guide the screen.

Thus, in the example indicated above, the screen guide means are of transverse type using transverse flexible reinforcing bars.

Figure 12:
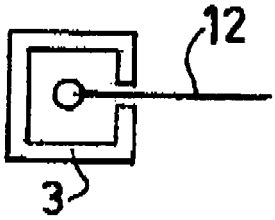
FIG. 12 is a cross section through a jamb for another embodiment of a door.

However, the guidance of the screen may be done laterally in each jamb, in which case the lateral edges of the screen 12 are each provided with a linear enlargement. These enlargements may for example consist of juxtaposed plastic pins forming a continuous enlargement. Each of these enlargements is engaged in an approximately C-section jamb (see FIG. 12) and thus defines a space closed by two opposing flanges. As regards lateral guidance, one possibility is to add rings to each lateral edge of the screen, while a vertical cable runs the full height of each jamb, and the rings are engaged on this cable, thus providing the lateral guidance of the screen. The cables inside the two jambs may incorporate an elastic device such as a spring to allow the screen to retreat for a limited distance in the event of a collision.

The screen 12 is also fitted along its bottom edge with a flexible bar 29 on which detecting means are mounted. The bar 29 may include a spring inserted in a foam sheath 30. The vertical enlargements present on each lateral edge of the screen 12, or in the alternative case the guide rings, stop at a distance of about 40 cm from the bar 29.

In a collision with, for example, a handling vehicle, the bar 29 first enables the impact with the screen to be detected. This usually causes the screen to rise. Depending on the severity of the impact, the bar 29 may then come out of one or both tracks without affecting the lateral guide members.

It may additionally be pointed out that the invention can be used on small doors without guide means. In this form of door the lateral edges of the screen 12 are simply engaged in tracks running down the jambs, while a bar 29 on which contact detecting means are mounted.

This relatively simple embodiment of the door behaves in the following manner in a collision with a person or vehicle. The collision is detected by the bending of the bar 29, which activates the detecting means.

It can thus be seen that the invention enables any contact with the screen of a fast door to be detected. This arrangement is highly advantageous when it comes to detecting a collision, as the invention makes use of the flexibility of at least one of the flexible reinforcing bars present inside the screen to detect a contact with the screen.

It should be added that, while the door thus defined is highly advantageous when it comes to responding to an accidental collision, the arrangements of the invention could be used for intentionally opening the door by defining, on the screen for example, a visual area on which a user can deliberately act on the bar to open the door itself.

The invention is not of course limited to the embodiments described above by way of non-restrictive example: on the contrary, it encompasses all embodiments thereof. For example, the door could open sideways rather than, as shown in the figures, vertically. It is also conceivable to fit a plurality of emitters and receivers to a bar, each emitter/receiver couple being located in planes at 180°, 120° or 90° depending on the desired sensitivity. The invention equally well to roll-up doors as to folding doors of the which the raising of the screen is done by means of one or more straps fixed to the bottom transverse edge of the screen.

The invention claimed is:

1. A fast door capable of closing an opening in a wall, comprising:

a structure having two jambs, in each of which a track is formed, and a transverse lintel element; and a flexible screen canvas connected to the structure through the lintel element by electromechanical means controlling a lowering and raising of the screen, the screen incorporating at least one flexible reinforcing bar inserted in receiving means formed in the screen, and the flexible reinforcing bar being engageable at its two ends in the corresponding tracks and being able to bend and come out of at least one track without suffering permanent deformation, wherein the door further comprises screen contact detecting means connected to at least one of the flexible reinforcing bars, wherein the detecting means is external of the bar and within the respective receiving means and can exhibit a state of normal operation when the bar is straight and a state of abnormal operation when the bar is bent owing to a contact with the screen.

2. The fast door as claimed in claim 1, wherein the detecting means comprise at least one emitter and at least one receiver, each connected rigidly to the same flexible reinforcing bar, at a distance from each other and coplanar with the bar, wherein at least one beam is propagated between the emitter and the receiver, the beam being parallel to the flexible reinforcing bar in normal operation of the door, and at least one beam being broken when the flexible reinforcing bar is bent, causing misalignment of the emitter with respect to the receiver.

3. The fast door as claimed in claim 1, wherein the screen comprises horizontal guide means comprising at least one bar, each end of which is engaged in one of the tracks, and contact detecting means connected to the flexible reinforcing bar located at a bottom edge of the screen.

4. The fast door as claimed in claim 3, wherein the flexible reinforcing bar to which are connected the contact detecting means situated on the bottom edge of the screen is approximately forty centimeters distant from a horizontal reinforcing bar immediately adjacent to it.

5. The fast door as claimed in one of claim 1, wherein the screen comprises lateral guide means that keep lateral edges of the screen in the jambs, and has at a bottom edge of the screen the flexible reinforcing bar comprising contact detecting means.

6. The fast door as claimed in claim 5, wherein the screen has no lateral guide means in the vicinity of the flexible reinforcing bar.

7. The fast door as claimed in claim 1, wherein the screen, whose lateral edges are engaged in the tracks of the jambs, has a flat surface without guide means, and has at a bottom edge of the screen a flexible reinforcing bar comprising contact detecting means.

8. The fast door as claimed in claim 2, wherein the emitter and receiver are located at respective ends of at least one flexible reinforcing bar.

9. The fast door as claimed in claim 1, wherein the screen comprises two superposed strips between which are sandwiched two consecutive panels defining a sheath in which the flexible reinforcing bar can be engaged.

10. The fast door as claimed in claim 1, wherein the screen comprises a tarpaulin folded on itself and attached to a bottom transverse edge of the screen.

11. The fast door as claimed in claim 1, wherein at least one of the flexible reinforcing bars comprises at least two brackets, both located in a single plane passing through the bar, one bracket supporting an emitter and one bracket supporting a receiver.

12. The fast door as claimed in claim 11, wherein at least one of the brackets attached to one of the bars comprises a jacket for keeping at a distance walls of a sheath in which said flexible reinforcing bar is engaged.

13. The fast door as claimed in claim 2, wherein at least one sleeve is positioned between an emitter and a receiver on one of the flexible reinforcing bars in such a way as to keep at a distance walls of a housing means in which said bar is engaged.

14. The fast door as claimed in claim 1, wherein at least one of the flexible reinforcing bars is made of a material capable of bending transversely, so that when an action is applied transversely to the flexible reinforcing bar the emitter and receiver become misaligned and/or the flexible reinforcing bar comes out of at least one of the tracks.

15. The fast door as claimed in claim 1, wherein at least one of the flexible reinforcing bars is a spiral spring equipped at each end with a rigid tube which is engageable in a track.

16. The fast door as claimed in claim 1, wherein each of the jambs comprises, at its top end, means for re-engaging a bar in the track with which said jamb is provided.

* * * * *